US009993125B2

(12) United States Patent
Hu

(10) Patent No.: US 9,993,125 B2
(45) Date of Patent: Jun. 12, 2018

(54) HANDHELD VACUUM CLEANER

(71) Applicant: JIANGSU MIDEA CLEANING APPLIANCES CO., LTD., Suzhou, Jiangsu (CN)

(72) Inventor: Wei Hu, Jiangsu (CN)

(73) Assignee: JIANGSU MIDEA CLEANING APPLIANCES CO., LTD., Suzhou, Jiangsu (CN)

( * ) Notice: Subject to any disclaimer, the term of this patent is extended or adjusted under 35 U.S.C. 154(b) by 30 days.

(21) Appl. No.: 15/178,492

(22) Filed: Jun. 9, 2016

(65) Prior Publication Data

US 2017/0188763 A1 Jul. 6, 2017

(30) Foreign Application Priority Data

Jan. 4, 2016 (CN) ..... 2016 1 0003757
Jan. 4, 2016 (CN) ..... 2016 2 0006101 U

(51) Int. Cl.

| | |
|---|---|
| ***A47L 5/26*** | (2006.01) |
| ***A47L 9/10*** | (2006.01) |
| ***A47L 9/22*** | (2006.01) |
| ***A47L 5/24*** | (2006.01) |
| ***A47L 9/16*** | (2006.01) |

(52) U.S. Cl.
CPC ..... *A47L 5/24* (2013.01); *A47L 9/1683* (2013.01); *A47L 9/22* (2013.01)

(58) Field of Classification Search
CPC ..... A47L 5/24; A47L 9/22; A47L 9/1683
USPC ..... 15/344, 412
IPC ..... A47L 5/26,9/10, 9/22
See application file for complete search history.

(56) References Cited

FOREIGN PATENT DOCUMENTS

| | | | |
|---|---|---|---|
| CN | 204909302 | * | 2/2015 |
| WO | WO2006076363 | * | 7/2006 |

* cited by examiner

*Primary Examiner* — David Redding
(74) *Attorney, Agent, or Firm* — Kile Park Reed & Houtteman PLLC

(57) ABSTRACT

A handheld vacuum cleaner 100 includes a housing 1, a dust cup, and an electric motor 3, in which the housing 1 is provided with an air inlet 11 and an air outlet 12; the dust cup is disposed in the housing 1; the electric motor 3 is disposed between the air inlet 11 and the dust cup, and the dusty airstream entering into the housing 1 from the air inlet 11 flows through the dust cup and the electric motor 3 successively and is exhausted from the air outlet 12.

19 Claims, 6 Drawing Sheets

HANDHELD VACUUM CLEANER

FIELD

The present invention relates to a field of cleaning technologies, and more particularly, to a handheld vacuum cleaner.

BACKGROUND

In the related art, a handheld vacuum cleaner has a single structure where an air inlet, a dust cup and an electric motor are arranged in sequence. Moreover, since the electric motor is relatively close to a handle, when the handheld vacuum cleaner is in practical work, the running electric motor will generate vibration of the handle, which degrades the sense of touch, and an air outlet of the handheld vacuum cleaner is relatively close to the human body, which weakens the comfort. Additionally, it is not convenient to assemble and disassemble the dust cup.

SUMMARY

The present invention aims to solve at least one of the problems existing in the related art to at least some extent. Thus, an objective of the present invention is to provide a handheld vacuum cleaner that improves the structure diversity of the handheld vacuum cleaner.

The handheld vacuum cleaner according to embodiments of the present invention includes: a housing provided with an air inlet and an air outlet; a dust cup disposed in the housing; and an electric motor disposed between the air inlet and the dust cup, in which a dusty airstream entering into the housing from the air inlet flow through the dust cup and the electric motor successively and is exhausted from the air outlet.

The handheld vacuum cleaner according to the embodiments of the present invention improves the structure diversity of the handheld vacuum cleaner by disposing the electric motor between the air inlet and the dust cup.

According to one embodiment of the present invention, the electric motor is disposed obliquely.

According to one embodiment of the present invention, the electric motor is obliquely extends downwards towards the air inlet along a flow direction of the airstream.

According to one embodiment of the present invention, the electric motor is disposed horizontally.

According to one embodiment of the present invention, the electric motor is disposed vertically.

According to one embodiment of the present invention, a communicating channel is provided between the air inlet and the dust cup, and includes at least one of a first sub-channel, a second sub-channel and a third sub-channel, in which the first sub-channel is disposed at at least one of two sides of the dust cup, the second sub-channel is disposed above the dust cup, and the third sub-channel is disposed below the dust cup.

According to one embodiment of the present invention, when the communicating channel includes the first sub-channel, two first sub-channels are provided and located on the two sides of the dust cup separately.

According to one embodiment of the present invention, an electric motor air hood is provided between the dust cup and the electric motor.

According to one embodiment of the present invention, the dust cup includes a body provided with an inlet and an outlet; a cyclone drum which is disposed inside the body and provided with a cyclone drum inlet communicating with the inlet, and has an open upper end; and a filter including a connection portion and a filtration portion, in which the connection portion is connected inside the body and has a lower surface spaced apart from an upper end surface of the cyclone drum, and the filtration portion has a first end connected to the connection portion and communicating with the outlet and a second end extending into the cyclone drum, and is provided with at least one communication hole communicated with the interior of the cyclone drum.

According to one embodiment of the present invention, the lower end of the filtration portion extends downwards to a bottom wall of the cyclone drum and is fixed to the bottom wall of the cyclone drum.

According to one embodiment of the present invention, the communication hole is formed in a sidewall of the filtration portion.

According to one embodiment of the present invention, the body includes: a cup body having an open top, in which the inlet is formed in a sidewall of the cup body; and a cup lid disposed at the top of the cup body, in which the outlet is formed in the cup body.

According to one embodiment of the present invention, the handheld vacuum cleaner further includes a filtering element disposed between the cup body and the cup lid.

According to one embodiment of the present invention, the filtering element is a filter cotton.

According to one embodiment of the present invention, the dust cup is detachably connected to the housing.

According to one embodiment of the present invention, the dust cup is provided with a handle.

According to one embodiment of the present invention, the handle is disposed on a side of the dust cup away from the air outlet.

According to one embodiment of the present invention, the handle and the dust cup are integrally formed.

According to one embodiment of the present invention, the air outlet is disposed adjacent to the electric motor.

According to one embodiment of the present invention, the air outlet is provided with an air outlet cover or plate and the air outlet cover or plate is provided with at least one air hole.

Additional aspects and advantages of the embodiments of the present invention will be given partially in the following descriptions, part of which will become apparent in the following descriptions, or be learned from the practice of the present invention.

BRIEF DESCRIPTION OF THE DRAWINGS

These and/or other additional aspects and advantages of the present invention will become apparent and more readily appreciated from the following descriptions of the embodiments made with reference to the drawings, in which.

REFERENCE NUMERALS

Figure 1:
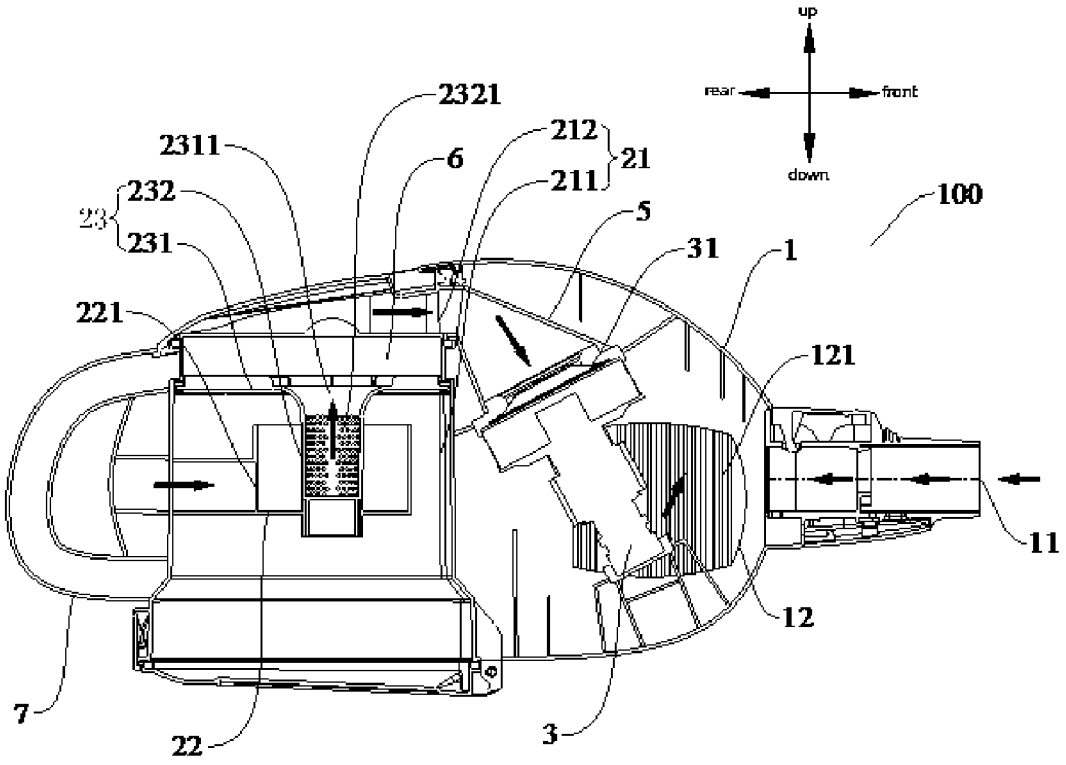
FIG. 1 is a schematic view of a handheld vacuum cleaner according to a first embodiment of the present invention.

100 handheld vacuum cleaner;
1 housing; 11 air inlet; 12 air outlet; 121 air outlet cover;
21 body; 211 cup body; 212 cup lid;
22 cyclone drum; 221 cyclone drum inlet;
23 filter; 231 connection portion; 2311 opening; 232 filtration portion; 2321 communication hole;
3 electric motor; 31 air inlet end;
41 first sub-channel; 42 second sub-channel; 43 third sub-channel;
5 electric motor air hood;
6 filtering element;
7 handle;

DETAILED DESCRIPTION

Embodiments of the present invention will be described in detail and examples of the embodiments will be illustrated in the accompanying drawings, where same or similar reference numerals are used to indicate same or similar members or members with same or similar functions. The embodiments described herein with reference to the drawings are explanatory, which aim to illustrate the present invention, but shall not be construed to limit the present invention.

In the specification, it shall be understood that terms such as "central," "longitudinal," "lateral," "length," "width," "thickness," "upper," "lower," "front," "rear," "left," "right," "vertical," "horizontal," "top," "bottom," "inner," "outer," "axial," "radial", "circumferential" should be construed to refer to the orientation or position as then described or as shown in the drawings under discussion. These relative terms are for convenience of description and do not indicate or imply that the present invention must have a particular orientation, or be constructed or operated in a particular orientation, and thus shall not be construed to limit the present invention. Moreover, in the description of the present invention, "a plurality" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications or interaction of two elements, which can be understood by those skilled in the art according to specific situations.

In the following, a handheld vacuum cleaner 100 according to the embodiments of the present invention will be illustrated with reference to FIGS. 1-10. The handheld vacuum cleaner 100 may be used to clean small space. For example, it can be used to clean inside of cars, keyboards or electric devices, along with a good cleaning effect. Moreover, the handheld vacuum cleaner 100 may perform different cleanings when equipped with different components. For example, it can be used to clean floors with a floor brush, to clean sofa surfaces, sheets and curtains with a flat brush and to clear away dusts in small corners and some household utensils with a suction nozzle.

As shown in FIGS. 1-10, the handheld vacuum cleaner 100 according to the embodiments of the present invention includes a housing 1, a dust cup and an electric motor 3.

The housing 1 is provided with an air inlet 11 and an air outlet 12. The dust cup is disposed in the housing 1. The electric motor is disposed between the air inlet 11 and the dust cup. In such a case, the structural arrangement sequence of the handheld vacuum cleaner 100 includes the air inlet 11, the electric motor 3 and the dust cup successively (for example, a front-to-rear sequence shown in FIGS. 1 to 10). A dusty airstream entering into the housing 1 from the air inlet 11 flows through the dust cup and the electric motor 3 successively and is exhausted from the air outlet 12.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween.

Specifically, a rotating shaft of the electric motor 3 is provided with a rotatable impeller. When the electric motor 3 is running, the impeller is driven to rotate by the electric motor 3 through the shaft and thus generates relatively strong suction and pressure. Under the action of the suction and pressure, the airstream flowing through the electric motor 3 is exhausted at a high speed while airstreams from an air inlet end 31 of the electric motor 3 (e.g. an upper end in FIG. 1) are supplied to the electric motor 3 continuously, which generates an instantaneous vacuum in the housing 1 and thus external dusty airstreams may be sucked into the housing 1 through the air inlet 11.

When the handheld vacuum cleaner 100 works, the dusty stream from the air inlet 11 firstly enters into the dust cup to be filtered, and the dust filtered out stays in the dust cup while the filtered air flows to the electric motor 3 and may cool the electric motor 3 in the process of flowing to the electric motor 3, thus prolonging the life of the electric motor 3. Afterward the air is exhausted from the air outlet 12 to the outside of the housing 1.

The handheld vacuum cleaner 100 according to the embodiments of the present invention improves the structure diversity of the handheld vacuum cleaner 100 by disposing the electric motor 3 between the air inlet 11 and the dust cup.

In the following, the handheld vacuum cleaner 100 according to a first specific embodiment of the present invention will be illustrated with reference to FIGS. 1 and 2.

Figure 2:
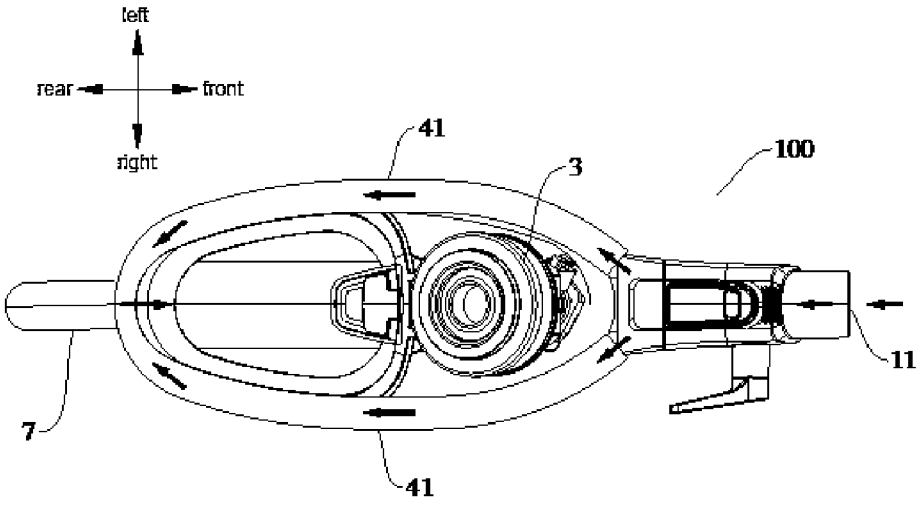
FIG. 2 is a top view of the handheld vacuum cleaner of FIG. 1.

As shown in FIGS. 1 and 2, the handheld vacuum cleaner 100 includes the housing 1, the dust cup and the electric motor 3. The air inlet 11 is disposed at a front end of the housing 1 and approximately located in the central of the housing 1; the dust cup is disposed at a rear end of the housing 1; the electric motor 3 is disposed inside the housing 1 and located between the air inlet 11 and the dust cup. Herein, it should be noted that, the direction "front" may be construed as the direction away from the human body when the handheld vacuum cleaner 100 is located at the front side of the human body during its practical use, and the opposite direction is defined to be "rear", i.e. the direction facing the human body when the handheld vacuum cleaner 100 is located at the front side of the human body during its practical use.

The electric motor 3 may be disposed obliquely. With reference to FIG. 1 and in combination with FIG. 2, a central axis of the electric motor 3 forms an acute angle respectively with the horizontal plane and the vertical plane, and the electric motor 3 may obliquely extend downwards towards the air inlet 11 (e.g. a rear-to-front direction in FIG. 1) along the flow direction of the airstream, but is not limited to this. For example, in the flowing direction of the streams and the direction of facing the air inlet 11, the electric motor 3 may obliquely extend upwards towards the air inlet 11 (not shown) along the flow direction of the airstream. Therefore, the occupation space of the electric motor 3 in the housing 1 is reduced by disposing it obliquely, so as to reduce the overall size of the handheld vacuum cleaner 100.

As shown in FIGS. 1 and 2, a communicating channel is provided between the air inlet 11 and the dust cup, and includes at least one of a first sub-channel 41, a second sub-channel 42 and a third sub-channel 43. That is to say, the communicating channel may merely include any one of the first sub-channel 41, the second sub-channel 42 and the third sub-channel 43, or include simultaneously any two of the first sub-channel 41, the second sub-channel 42 and the third sub-channel 43, or include simultaneously the three of the first sub-channel 41, the second sub-channel 42 and the third sub-channel 43. The first sub-channel 41 is disposed at at least one of two sides of the dust cup, the second sub-channel 42 is disposed above the dust cup, and the third sub-channel 43 is disposed below the dust cup.

Terms such as "first", "second" or "third" are used herein for purposes of description and are not intended to indicate or imply relative importance or significance or to imply the number of indicated technical features. Thus, the feature defined with "first", "second" or "third" may explicitly or implicitly includes one or more of this feature.

Alternatively, when the communicating channel includes the first sub-channel 41, two first sub-channels 41 are provided and located at the two sides of the dust cup separately. As shown in FIG. 2, the communicating channel only includes two first sub-channels 41, both of which extend in the front-and-rear direction and are located on the left and right sides of the dust cup separately, and preferably they are symmetrical with respect to a central vertical plane of the housing 1 extending in the front-and-rear direction. Thus, the dusty airstreams from the air inlet 11 may flow rearwards from the left side and the right side of the dust cup into the dust cup respectively via the two first sub-channels 41.

Specifically, as shown in FIG. 1, the dust cup includes a body 21, a cyclone drum 22 and a filter 23. The body 21 is provided with an inlet and an outlet and includes a cup body 211 and a cup lid 212. The top of the cup body 211 is open, and the inlet is formed in a sidewall of the cup body 211. The cup lid 212 is disposed at the top of the cup body 211, and the outlet is formed in the cup lid 212. Thus, the dusty airstreams from the air inlet 11 may enter the cup body 211 via the inlet, and the filtered air may be exhausted from the outlet to the outside of the cup body 211.

The cyclone drum 22 is disposed inside the body 21 and provided with a cyclone drum inlet 221 communicating with the inlet, and has an open upper end. The filter 23 includes a connection portion 231 and a filtration portion 232, in which the connection portion 231 is substantially formed as a flat plate and the connection portion 231 is connected inside the body 21. For example, an outer circumferential wall of the connection portion 231 may be connected to an inner circumferential wall of the cup body 211, in which case the filter 23 is mounted inside the cup body 211 via the connection portion 231. An opening 2311 is provided in the center of the connection portion 231 and perforates in the thickness direction of the connection portion 231 (e.g. the up-and-down direction in FIG. 1). A lower surface of the connection portion 231 is spaced apart from an upper end surface of the cyclone drum 22, and at this moment the connection portion 231 is not in touch with the cyclone drum 22. The filtration portion 232 has a substantially hollow tubular structure, in which a first end of the filtration portion 232 (e.g. an upper end in FIG. 1) is connected to the connection portion 231 and communicated with the outlet, i.e. the first end of the filtration portion 232 is communicated with the opening 2311 of the connection portion 231, and a second end (e.g. a lower end in FIG. 1) thereof extends into the cyclone drum 22. The filtration portion 232 is provided with at least one communication hole 2321 communicated with the interior of the cyclone drum 22.

Therefore, the dusty airstreams from the inlet may enter the cyclone drum 22 via the cyclone drum inlet 221; air and dust of the dusty airstreams may be separated in the cyclone drum 22; and the dust separated out will be gathered by the cup body 211, so as to achieve the purpose of dust collection and filtration. The filtered air flows through the communication hole 2321 of the filtration portion 232 and the opening 2311 of the connection portion 231 successively, and is exhausted from the outlet eventually. By spacing the lower surface of the connection portion 231 apart from the upper end surface of the cyclone drum 22, the impurities having a light weight and a large volume, such as tissues, may also be separated out by the cyclone drum 22 and enter into the cup body 211, which can avoid blocking up the filter 23 effectively and make the filter 23 keep clean to improve performance of the filter 23, so as to reduce failure rate of the handheld vacuum cleaner 100 and facilitate use and maintenance thereof.

As shown in FIG. 1, the communication hole 2321 is formed in a sidewall of the filtration portion 232. Therefore, the filtered air may enter the filtration portion 232 via the communication hole 2321. Further, a plurality of the communication holes 2321 provided in the sidewall of the filtration portion 232 and spaced apart from one another other. Preferably, the plurality of communication holes 2321 are evenly spaced and distributed in the sidewall of the filtration portion 232.

Alternatively, the communication hole 2321 may be a circular hole that is simple to process at a low cost, and certainly, the communication hole 2321 also may be an oval hole, an oblong hole or a polygonal hole, etc. It can be understood that the number, the specific shape, the size of the communication hole 2321 and its arrangement in the filtration portion 232 may be determined according to the actual requirements, to make sure a better filtration effect.

With reference to FIG. 1, the lower end of the filtration portion 232 extends downwards to a bottom wall of the cyclone drum 22 and is fixed to the bottom wall of the cyclone drum 22. For example, the bottom wall of the cyclone drum 22 is provided with a connecting hole perforating in the thickness direction of the bottom wall (e.g. the up-and-down direction in FIG. 1), and the lower end of the filtration portion 232 may pass through the connecting hole. Therefore, the filtration portion 232 may be mounted inside the cup body 211 more firmly.

Further, the handheld vacuum cleaner includes a filtering element 6 that is disposed between the cup body and the cup lid 212 and located at the downstream of the filter 23. Therefore, the airstreams separated by the cyclone drum 22 may be further filtered by the filtering element 6 before flowing to the electric motor 3, thus further guaranteeing the normal use of the electric motor 3. Herein, it should be noted that the "downstream" may be understood as downstream of the flow direction of the airstream. Alternatively, the filtering element 6 is a filter cotton, but not limited to this.

As shown in FIG. 1, an electric motor air hood 5 is provided between the dust cup and the electric motor 3 and connected between the outlet of the dust cup and the air inlet end 31 of the electric motor 3. The electric motor air hood 5 may be constructed to have a sectional area increasing gradually in the flow direction of the airstreams. Therefore, the airstreams filtered by the dust cup may be directed to the electric motor 3 better.

The dust cup may be detachably mounted to the housing 1. Since the dust cup is located in the rear of the housing 1, it is convenient to mount and remove the dust cup. Further, the dust cup is provided with a handle 7 that is disposed on the side of the dust cup away from the air outlet 11 (e.g. the rear side in FIG. 1), and simultaneously the handle 7 is disposed on the side of dust cup away from the electric motor 3. In such a case, the handle 7 is relatively remote from the electric motor 3, thus reducing vibration of the handle 7 and improving the sense of touch during use.

Alternatively, the handle 7 and the dust cup may be integrally formed, and hence the handle 7 and the dust cup are integrally processed and manufactured, such that the handle 7 is a part of the dust cup. Therefore, users can remove the dust cup by holding the handle 7, resulting in convenient assembling or disassembling and simple processing, thus reducing the cost.

Preferably, the air outlet 12 is disposed close to the electric motor 3, such that the airstreams flowing through the electric motor 3 may be exhausted from the air outlet 12 directly. Moreover, since the air outlet 12 is relatively remote from the human body, it improves the comfort of using the handheld vacuum cleaner. Specifically, as shown in FIG. 1, the air outlet 12 is substantially disposed in the front of the housing 1, and may be provided with an air outlet cover 121 that is provided with at least one air hole. Therefore, by disposing the outlet cover 121, it is possible to guarantee the safety of users effectively at the same time of ensuring the air exhaust effect.

In the following, the handheld vacuum cleaner 100 according to a second specific embodiment of the present invention will be illustrated with reference to FIG. 3.

Figure 3:
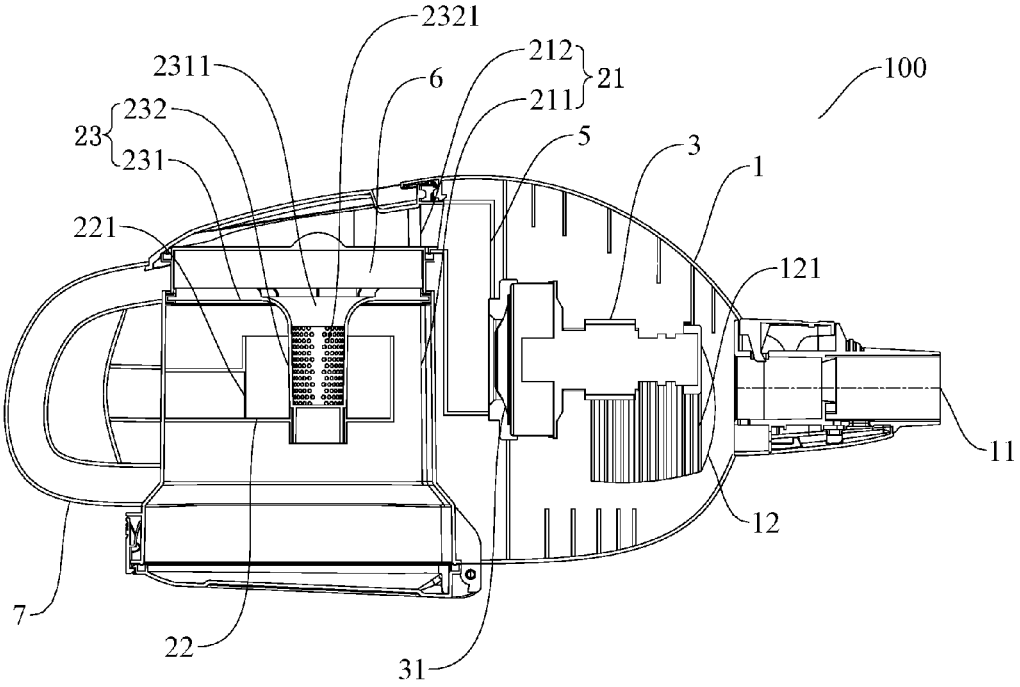
FIG. 3 is a schematic view of a handheld vacuum cleaner according to a second embodiment of the present invention.

In the present embodiment, as shown in FIG. 3, the electric motor 3 is disposed horizontally. In such a case, the central axis of the electric motor 3 extends in the front-and-rear direction, and the angle between the central axis of the electric motor 3 and the horizontal plane is zero degree. Therefore, it is convenient to assemble the electric motor 3 with a high efficiency. The electric motor air hood 5 has a substantially inverted "L" shape and a sectional area substantially keeping constant in the flow direction of the airstreams.

Other structures (e.g. the dust cup) of the handheld vacuum cleaner 100 according to this embodiment may be identical to those of the handheld vacuum cleaner 100 according to the first specific embodiment, which will not be described in detail.

In the following, the handheld vacuum cleaner 100 according to a third specific embodiment of the present invention will be illustrated with reference to FIG. 4.

Figure 4:
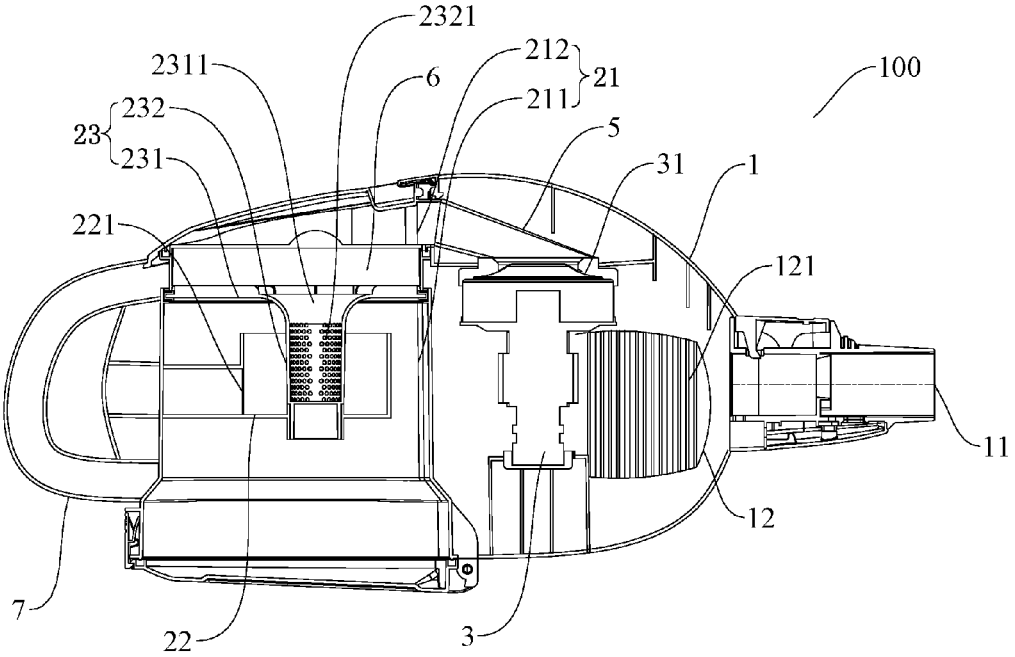
FIG. 4 is a schematic view of a handheld vacuum cleaner according to a third embodiment of the present invention.

In the present embodiment, as shown in FIG. 4, the electric motor is disposed vertically. In such a case, the central axis of the electric motor 3 extends in the up-and-down direction, and the angle between the central axis of the electric motor 3 and the vertical plane is zero degree. Therefore, it is convenient to assemble the electric motor 3 with a high efficiency. The electric motor air hood 5 obliquely extends downwards towards the air inlet 11 in the flow direction of airstreams.

Other structures (e.g. the dust cup) of the handheld vacuum cleaner 100 according to this embodiment may be identical to those of the handheld vacuum cleaner 100 according to the first specific embodiment, which will not be described in detail.

In the following, the handheld vacuum cleaner 100 according to a fourth specific embodiment of the present invention will be illustrated with reference to FIG. 5.

Figure 5:
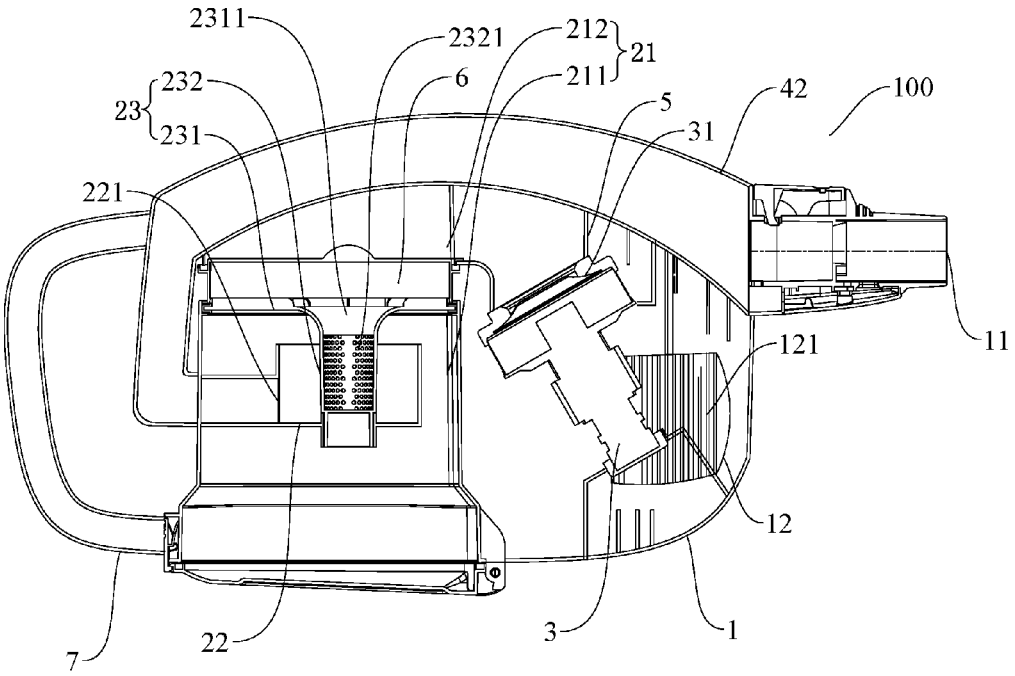
FIG. 5 is a schematic view of a handheld vacuum cleaner according to a fourth embodiment of the present invention.

In this embodiment, as shown in FIG. 5, the communicating channel only includes the second sub-channel 42, and the second sub-channel 42 is disposed at the upper part of the dust cup and forms an arc shape projecting upwards. The dusty airstreams entering from the air inlet 11 may flow rearwards from the upper part of the dust cup into the dust cup via the second sub-channel 42. The air inlet 11 is disposed in the upper part of the housing 1. The electric motor 3 is disposed obliquely.

Other structures (e.g. the dust cup) of the handheld vacuum cleaner 100 according to this embodiment may be identical to those of the handheld vacuum cleaner 100 according to the first specific embodiment, which will not be described in detail.

In the following, the handheld vacuum cleaner 100 according to a fifth specific embodiment of the present invention will be illustrated with reference to FIG. 6.

Figure 6:
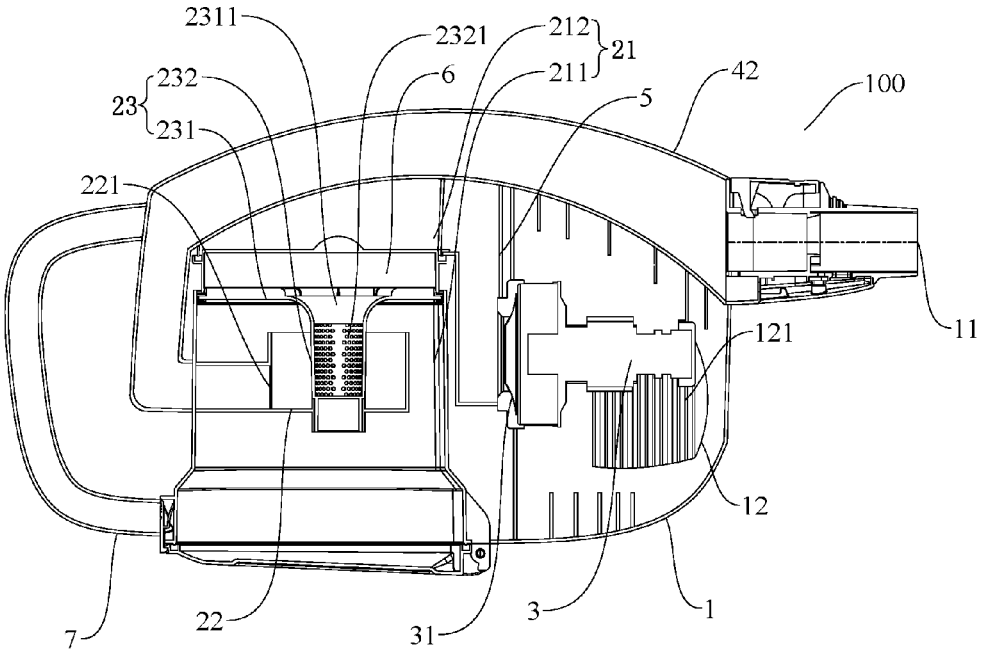
FIG. 6 is a schematic view of a handheld vacuum cleaner according to a fifth embodiment of the present invention.

As shown in FIG. 6, the only difference between this embodiment and the fourth specific embodiment is that the electric motor 3 is disposed horizontally. Other structures (e.g. the dust cup) of the handheld vacuum cleaner 100 according to this embodiment may be identical to those of the handheld vacuum cleaner 100 according to the first and fourth specific embodiments, which will not be described in detail.

In the following, the handheld vacuum cleaner 100 according to a sixth specific embodiment of the present invention will be illustrated with reference to FIG. 7.

Figure 7:
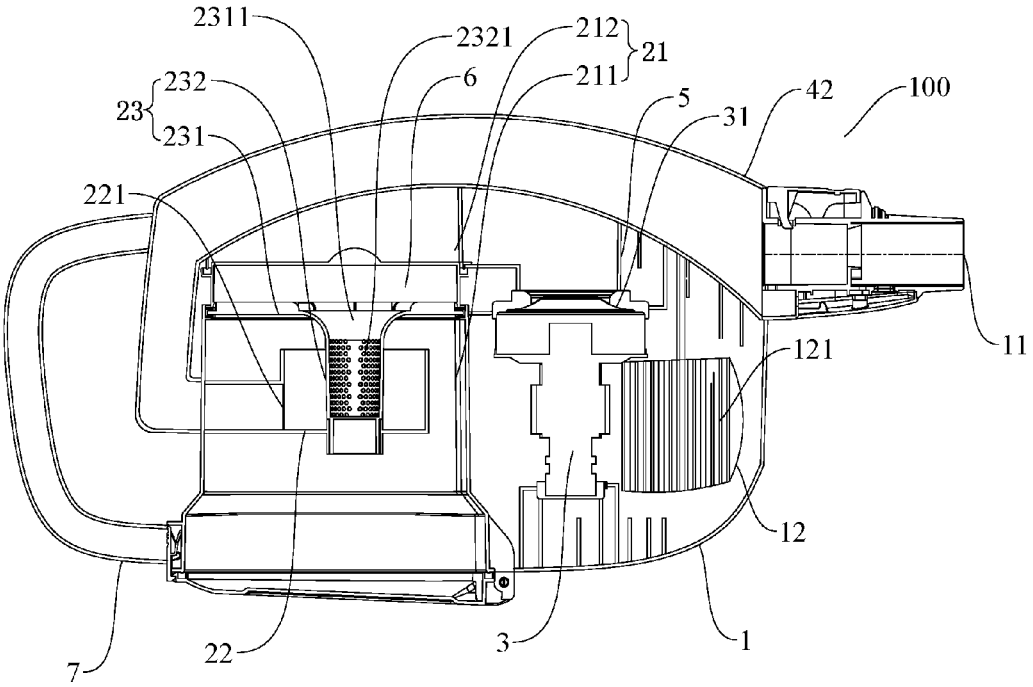
FIG. 7 is a schematic view of a handheld vacuum cleaner according to a sixth embodiment of the present invention.

As shown in FIG. 7, the only difference between this embodiment and the fourth specific embodiment is that the electric motor 3 is disposed vertically. Other structures (e.g. the dust cup) of the handheld vacuum cleaner 100 according to this embodiment may be identical to those of the handheld vacuum cleaner 100 according to the first and fourth specific embodiments, which will not be described in detail.

In the following, the handheld vacuum cleaner 100 according to a seventh specific embodiment of the present invention will be illustrated with reference to FIG. 8.

Figure 8:
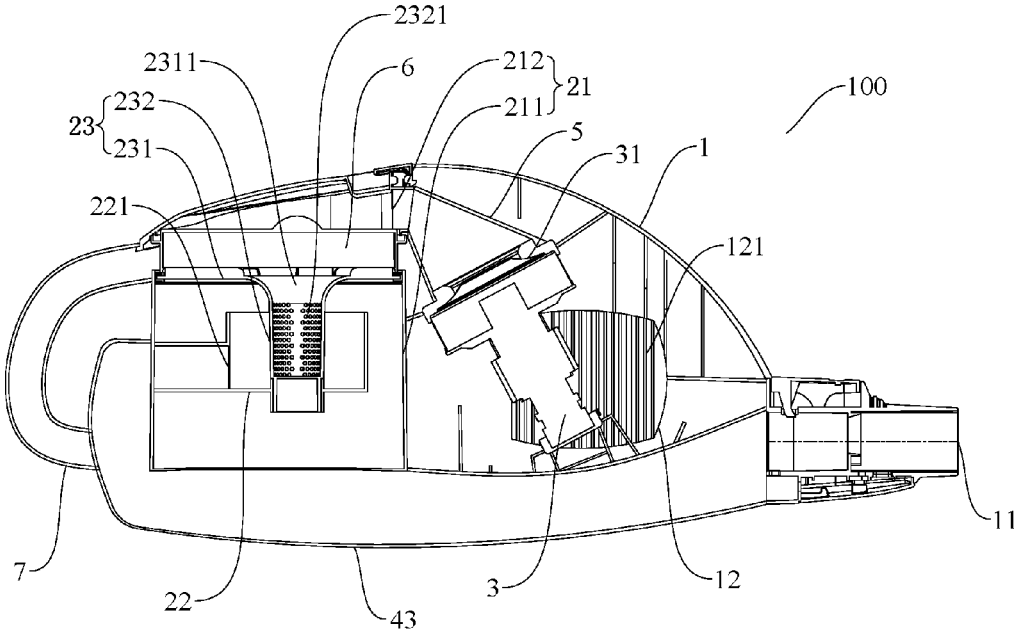
FIG. 8 is a schematic view of a handheld vacuum cleaner according to a seventh embodiment of the present invention.

In this embodiment, as shown in FIG. 8, the communicating channel only includes the third sub-channel 43, and the third sub-channel 43 is disposed at the lower part of the dust cup and substantially extends in the horizontal direction. The dusty airstreams entering from the air inlet 11 may flow rearwards from the lower part of the dust cup into the dust cup via the third sub-channel 43. The air inlet 11 is disposed in the lower part of the housing 1. The electric motor 3 is disposed obliquely.

Other structures (e.g. the dust cup) of the handheld vacuum cleaner 100 according to this embodiment may be identical to those of the handheld vacuum cleaner 100 according to the first specific embodiment, which will not be described in detail.

In the following, the handheld vacuum cleaner 100 according to an eighth specific embodiment of the present invention will be illustrated with reference to FIG. 9.

Figure 9:
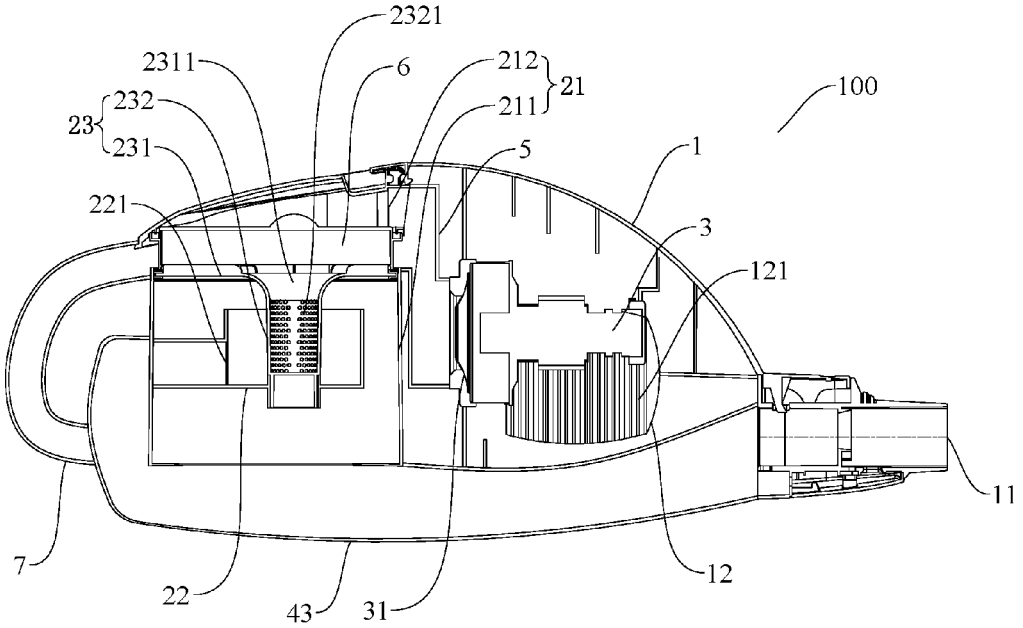
FIG. 9 is a schematic view of a handheld vacuum cleaner according to an eighth embodiment of the present invention.

As shown in FIG. 9, the only difference between this embodiment and the seventh specific embodiment is that the electric motor 3 is disposed horizontally. Other structures (e.g. the dust cup) of the handheld vacuum cleaner 100 according to the present embodiment may be identical to those of the handheld vacuum cleaner 100 according to the first and seventh specific embodiments, which will not be described in detail.

In the following, the handheld vacuum cleaner 100 according to a ninth specific embodiment of the present invention will be illustrated with reference to FIG. 10.

Figure 10:
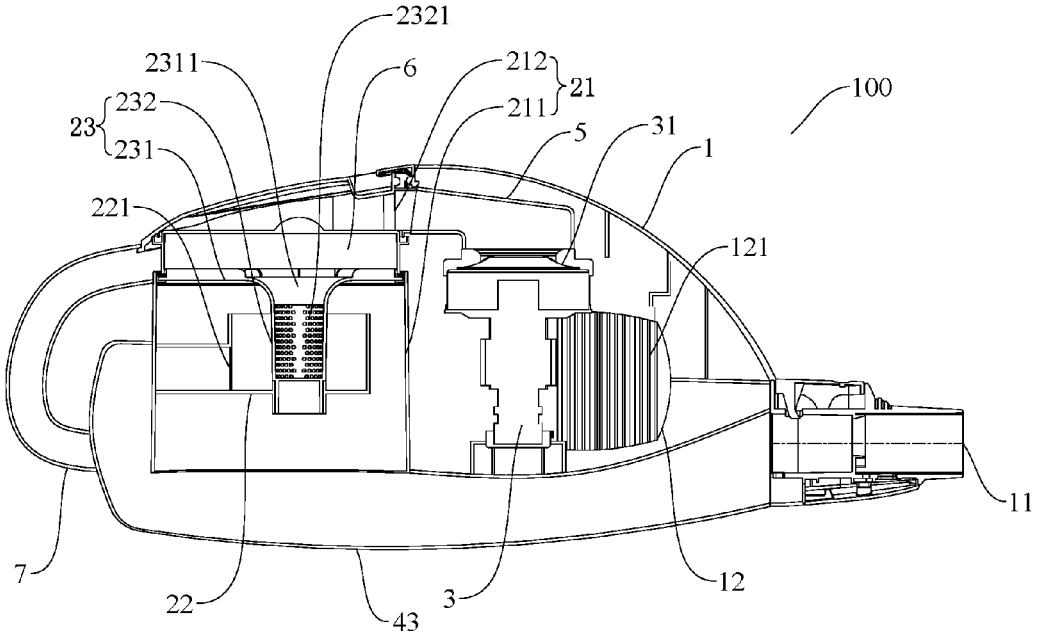
FIG. 10 is a schematic view of a handheld vacuum cleaner according to a ninth embodiment of the present invention.

As shown in FIG. 10, the only difference between this embodiment and the seventh specific embodiment is that the electric motor 3 is disposed vertically. Other structures (e.g. the dust cup) of the handheld vacuum cleaner 100 according to this embodiment may be identical to those of the handheld vacuum cleaner 100 according to the first and seventh specific embodiments, which they will not be described in detail.

It can be understood that, the specific arrangement of the electric motor 3 and the communicating channel can be adaptively changed according to the actual requirements, to meet the actual requirements better.

The handheld vacuum cleaner 100 according to the embodiments of the present invention, improves the structure diversity of the handheld vacuum cleaner 100. Moreover, the electric motor 3 is provided between the air inlet 11 and the dust cup and located remote from the handle 7 of the handheld vacuum cleaner 100, such that only slight vibration is delivered to the handle 7 when the handheld vacuum cleaner 100 is working, which improves the sense of touch of the handheld vacuum cleaner 100. Moreover, since the air outlet 12 is relatively remote from the human body, the comfort during use is enhanced. Additionally, it is convenient to assemble and disassemble the dust cup by disposing it in the rear of the housing 1.

Other compositions and operations of the handheld vacuum cleaner 100 according to the embodiments of the present invention are known to those skilled in the art, herein they will not be described in detail.

In the description of the present specification, reference to "an embodiment", "some embodiments", "schematic embodiments", "examples", "a specific example", or "some examples" means that a particular feature, structure, material, or characteristic described in connection with the embodiment or example is included in at least one embodiment or example of the present invention. Thus, the schematic expressions of the above-mentioned phrases throughout the present specification are not necessarily referring to the same embodiment or example of the present invention. Furthermore, the particular features, structures, materials, or characteristics may be combined in any suitable manner in one or more embodiments or examples.

Although explanatory embodiments have been shown and described, it would be appreciated by those skilled in the art that changes, modifications, alternatives, and transformations can be made in the embodiments without departing from principles and purposes of the present invention and the scope of the present invention will be limited by the claims and its equivalents.

What is claimed is:

1. A handheld vacuum cleaner, comprising:

a housing provided with an air inlet and an air outlet;

a dust cup disposed in the housing; and an electric motor disposed between the air inlet and the dust cup, a dusty airstream entering the housing from the air inlet flows through the dust cup and the electric motor successively and is exhausted from the air outlet, a communicating channel is provided between the air inlet and the dust cup and comprises two first sub-channels, and the two first sub-channels are provided and located outside two sides of the dust cup respectively.

2. The handheld vacuum cleaner according to claim 1, wherein the electric motor is disposed obliquely.

3. The handheld vacuum cleaner according to claim 2, wherein the electric motor obliquely extends downwards towards the air inlet along a flow direction of the airstream.

4. The handheld vacuum cleaner according to claim 1, the electric motor is disposed horizontally.

5. The handheld vacuum cleaner according to claim 1, the electric motor is disposed vertically.

6. The handheld vacuum cleaner according to claim 1, wherein the communicating channel further comprises at least one of a second sub-channel and a third sub-channel, the second sub-channel being disposed above the dust cup, and the third sub-channel being disposed below the dust cup.

7. The handheld vacuum cleaner according to claim 1, wherein an electric motor air hood is provided between the dust cup and the electric motor.

8. The handheld vacuum cleaner according to claim 1, wherein the dust cup comprises:

a body provided with an inlet and an outlet;

a cyclone drum disposed inside the body and provided with a cyclone drum inlet communicating with the inlet, wherein an upper end of the cyclone drum is open; and a filter comprising a connection portion and a filtration portion, wherein the connection portion is connected inside the body and has a lower surface spaced apart from an upper end surface of the cyclone drum, and the filtration portion has a first end connected to the connection portion and communicating with the outlet and a second end extending into the cyclone drum and is provided with at least one communication hole communicated with the interior of the cyclone drum.

9. The handheld vacuum cleaner according to claim 8, wherein a lower end of the filtration portion extends downwards to a bottom wall of the cyclone drum and is fixed to the bottom wall of the cyclone drum.

10. The handheld vacuum cleaner according to claim 8, wherein the communication hole is formed in a sidewall of the filtration portion.

11. The handheld vacuum cleaner according to claim 8, wherein the body comprises:

a cup body having an open top, wherein the inlet is formed in a sidewall of the cup body; and a cup lid disposed at the top of the cup body, wherein the outlet is formed in the cup lid.

12. The handheld vacuum cleaner according to claim 11, further comprising a filtering element disposed between the cup body and the cup lid.

13. The handheld vacuum cleaner according to claim 12, wherein the filtering element is filter cotton.

14. The handheld vacuum cleaner according to claim 1, wherein the dust cup is detachably connected to the housing.

15. The handheld vacuum cleaner according to claim 1, wherein the dust cup is provided with a handle.

16. The handheld vacuum cleaner according to claim 15, wherein the handle is disposed on a side of the dust cup away from the air outlet.

17. The handheld vacuum cleaner according to claim 15, the handle and the dust cup are integrally formed.

18. The handheld vacuum cleaner according to claim 1, wherein the air outlet is disposed adjacent to the electric motor.

19. The handheld vacuum cleaner according to claim 1, wherein the air outlet is provided with an air outlet cover and the air outlet cover is provided with at least one air hole.

* * * * *